US006021296A

United States Patent [19]

Tamura et al.

[11] Patent Number: 6,021,296

[45] Date of Patent: Feb. 1, 2000

[54] MAGNET ROLLER AND MANUFACTURING METHOD THEREOF

[75] Inventors: Hajime Tamura, Kawasaki; Yasuro Shiomura, Kodaira, both of Japan

[73] Assignee: Bridgestone Corporation, Tokyo, Japan

[21] Appl. No.: 09/035,034

[22] Filed: Mar. 5, 1998

[30] Foreign Application Priority Data

| | | | |
|---|---|---|---|
| Mar. 6, 1997 | [JP] | Japan | 9-069046 |
| Feb. 19, 1998 | [JP] | Japan | 10-054450 |
| Feb. 19, 1998 | [JP] | Japan | 10-054451 |

[51] Int. Cl.[7] ..... G03G 15/09

[52] U.S. Cl. ..... 399/277; 335/296; 335/302; 335/306; 399/279; 492/8

[58] Field of Search ..... 399/275, 279, 399/277; 335/296, 298, 297, 302, 306; 492/8

[56] References Cited

U.S. PATENT DOCUMENTS

| | | | |
|---|---|---|---|
| 4,185,262 | 1/1980 | Watanabe et al. | 335/302 |
| 4,326,908 | 4/1982 | Hiya et al. | 335/302 X |
| 4,509,031 | 4/1985 | Sakata et al. | 335/306 |
| 4,536,230 | 8/1985 | Landa et al. | 335/306 X |
| 4,557,582 | 12/1985 | Kan et al. | 399/277 |
| 4,558,294 | 12/1985 | Yamashita | 399/279 X |
| 5,529,628 | 6/1996 | Fuchiwaki et al. | 399/275 |

*Primary Examiner*—Fred L Braun

*Attorney, Agent, or Firm*—Sughrue, Mion, Zinn, MacPeak & Seas, PLLC

[57] ABSTRACT

A magnet roller capable of adjusting the height and position of a magnetic force peak after formation of a roller, and easily meeting a requirement to attain a complex magnetic force pattern without significantly increasing the cost. In the magnet roller, at least two kinds of first magnet pieces and second magnet pieces different from each other in orientation characteristic of magnetic powders are fixedly disposed around the outer periphery of a shaft. The first magnet pieces is a magnet piece in which anisotropic magnetic powders are oriented in such a manner to converge from both the side surfaces and the back surface to a specific position on the front surface side. The second magnet pieces are one kind or two or more kinds of magnet pieces such as a magnet piece in which anisotropic magnetic powders are oriented at random, a magnet piece in which anisotropic magnetic powders are uniformly or radially oriented in a specific direction from the back surface side to the front surface side, and a magnet piece using isotropic magnetic powders with no orientation characteristic.

9 Claims, 7 Drawing Sheets

MAGNET ROLLER AND MANUFACTURING METHOD THEREOF

BACKGROUND OF THE INVENTION

The present invention relates to a magnet roller suitably used for a developing mechanism portion for supplying a developer to a latent image support such as a photosensitive drum so as to develop an electrostatic latent image on the latent image support in an electrophotographic process using a copying machine, facsimile, printer or the like, and a method of manufacturing the magnet roller.

Conventionally, in an electrophotographic device or electrostatic recording device such as a copying machine or printer, there has been a developing method in which as a developing roller for visualizing an electrostatic latent image on a latent image support such as a photosensitive drum, a magnet roller formed of a resin or rubber magnet is disposed in a rotating sleeve, and a magnetic developer (toner) supported on the surface of the sleeve is supplied on the surface of the latent image support by a so-called jumping phenomenon (which allows the toner to be jumped on the latent image support due to a magnetic force characteristic of the magnet roller), to thereby visualize the electrostatic latent image.

The above described magnet roller has been manufactured by injection-molding or extruding, using a mold around which a magnetic field is formed, pellets of a resin or rubber composition containing magnetic powders of a ferrite or the like mixed in a binder composed of a thermoplastic resin such as nylon or polypropylene or a rubber, into a roller shape, and magnetizing the roller to give a desired magnetic force characteristic to the roller.

With the recent progress of electrophotographic devices and the like, more complex magnetic force patterns have been required for magnet rollers. However, the related art magnet rollers have a limitation to a magnetic force pattern to be designed, and cannot sufficiently meet the above requirement.

For this reason, to increase the degree of freedom in magnetic force pattern of a magnet roller, there has been adopted a method in which a plurality of magnet pieces in which magnetic poles corresponding to a desired magnetic force pattern are magnetized are formed of resin or rubber magnets and are stuck around a shaft, to thereby attain the desired magnetic force pattern.

In this case, to obtain the above magnet piece having a high magnetic force peak, there has been proposed a method of molding the magnet piece using a mold shown in FIG. 2 (Japanese Patent No. 2512025). The mold shown in FIG. 2 is configured that magnetic material members 3*a* and 3*b* made from iron or the like are disposed on upper and lower sides with a non-magnetic material member 2 put therebetween, and a cavity 1 is formed between the magnetic material members 3*a* and 3*b*. Using such a mold, the magnet piece is formed by injection-molding or extruding the above resin or magnet material in a state in which a coil 4 is applied with a current to form a magnetic field around the cavity 1. In this case, there has been proposed a method in which the above magnet piece is molded using such a mold that both side surfaces and the back surface (opposed to the front surface side) of the cavity 1 are formed of the magnetic material member 3*b* and the upper magnetic material member 3*a* is provided with a projecting portion 5 in such a manner that the leading end of the projecting portion 5 is disposed in the vicinity of a specific position of the cavity 1 on the front surface side. In the magnet piece molded using such a mold, as shown by arrows in FIG. 2, magnetic powders are oriented in such a manner as to be converged from both the side surfaces and the back surface side to a specific position on the front surface side, to thereby obtain a high magnetic force peak.

However, in the magnet roller in which a plurality of magnet pieces molded using the mold shown in FIG. 2 are fixedly disposed around the outer periphery of a shaft, the magnetic force peak of each magnetic pole is increased by the above-described orientation characteristic. However, when a low magnetic force is required, the diameter of the magnet piece must be reduced, or when the magnetic force peak is moved to a position offset from the central portion of the magnet piece, the magnet piece must be molded using the mold modified such that the projecting portion 5 provided on the upper magnetic material member 3*a* is located at a position offset from the central portion of the cavity 1 as shown in FIG. 3. That is, magnet pieces must be molded using various kinds of molds corresponding to the magnetic force patterns necessary for the magnet pieces, to thereby increase the manufacturing cost of the magnet roller formed of the magnet pieces.

In manufacture of a magnet roller, there has been adopted a method in which a magnet roller molded using a mold in which a magnetic field is applied around a cavity is magnetized once and then magnetized again to give a desired magnetic force pattern thereto. However, for the magnet roller formed of magnet pieces molded using the mold shown in FIG. 2 or 3, the position of the magnetic force peak is very restricted due to the above-described orientation characteristic. Accordingly, if the magnetic force peak is moved after formation of the roller in which the magnet pieces are fixedly disposed around a shaft, there occurs a problem in which a magnetic force is significantly reduced. That is, actually, the magnetic force peak cannot be moved after formation of the magnet roller.

SUMMARY OF THE INVENTION

An object of the present invention is to provide a magnet roller capable of, even when a partially low magnetic force peak is required, meeting such a requirement without changing dimensions of magnet pieces; of easily moving, when positions of magnetic force peaks of magnet pieces are intended to be moved, the positions of the magnetic force peaks without use of various kinds of molds; and of easily meeting a requirement to attain a complex magnetic force pattern, without significantly increasing a manufacturing cost, and a method of manufacturing the magnet roller.

The inventor has made studies to achieve the above object, and found that in a magnet roller wherein a plurality of magnet pieces in each of which magnetic powders are dispersed in a resin or rubber binder are fixedly disposed around the outer periphery of a shaft to form a magnet layer around the outer periphery of the shaft, it is effective to use, as the plurality of the magnet pieces, a combination of at least two kinds of first magnet pieces in each of which anisotropic magnetic powders are oriented in such a manner as to be converged from both the side surfaces and the back surface side to a specific position on the front surface side, second magnetic pieces in each of which anisotropic magnetic powders are oriented at random or uniformly or radially oriented in a specific direction from the back surface side to the front surface side, or second magnet pieces using isotropic magnetic powders having no orientation characteristic. That is, it has been found that, by use of the above first magnet piece for a portion requiring a high magnetic force peak, and also by use of the above second magnet piece for a portion requiring a relatively low magnetic force peak or a portion in which the position of the magnetic force peak is required to be finely moved and adjusted, the portion requiring a high magnetic force peak can ensure the sufficiently high magnetic force peak, and the portion requiring a low magnetic force peak or the portion in which the position of the magnetic force peak must be finely adjusted can simply ensure the low magnetic force peak or positional adjustment of the magnetic force peak by magnetizing operation performed after formation of the magnet roller, with a result that magnet rollers capable of meeting the recent requirement to attain complex magnetic force patterns can be obtained at a low cost without use of various kinds of molds.

To be more specific, the first magnet piece molded using the mold shown in FIG. 2 such that anisotropic magnetic powders are oriented in such a manner converge from both the side surfaces and the back surface side to a specific position on the front surface side, is used for a portion requiring a relatively high magnetic force peak. Besides, the second magnet piece, without being applied with orientation treatment, in which anisotropic magnetic powders are oriented at random; the second magnet piece molded using the mold shown in FIG. 1 in which either of the upper and lower magnetic material members 3*a* and 3*b* has no projecting portion and the cavity 1 is formed in the non-magnetic material member 2 in such a manner that anisotropic magnetic powders are uniformly or radially oriented in a specific direction from the back surface side to the front surface side. Alternatively, the second magnet piece using isotropic magnetic powders with no orientation characteristic, is used for a portion requiring a relatively low magnetic force peak or a portion in which the position of the magnetic force peak must be moved and adjusted. Then, if needed, before or after these first and second magnet pieces are fixedly disposed around a shaft to form a magnet roller, they are demagnetized once and magnetized again to give a desired magnetic force pattern to the magnet roller. This makes it possible to adjust the height of a magnetic force peak of the second magnet piece portion and relatively freely move the position of the magnetic force peak, and hence to obtain magnet rollers capable of meeting the requirement to attain complex magnetic force patterns without use of various kinds of molds. The present invention has been accomplished on the basis of the above-described knowledge.

According to a first aspect of the present invention, there is provided a magnet roller wherein a plurality of magnet pieces in each of which magnetic powders are dispersed in a resin or rubber binder are fixedly disposed around the outer periphery of a shaft, to form a magnet layer around the outer periphery of the shaft, characterized in that the plurality of magnet pieces include at least two kinds of first magnet pieces and second magnet pieces different from each other in orientation characteristic of magnetic powders; each of the first magnet pieces is a magnet piece in which anisotropic magnetic powders are oriented in such a manner as to be converged from both the side surfaces and the back surface to a specific position on the front surface side; and the second magnet pieces are one kind or two or more kinds of magnet pieces selected from a group consisting of a magnet piece in which anisotropic magnetic powders are oriented at random, a magnet piece in which anisotropic magnetic powders are uniformly or radially oriented in a specific direction from the back surface side to the front surface side, and a magnet piece using isotropic magnetic powders with no orientation characteristic.

According to a second aspect of the present invention, there is provided a method of manufacturing a magnet roller, including the steps of: by molding a resin or rubber magnet composition in which magnetic powders are disposed in a resin or rubber binder using a mold, to form a plurality of magnet pieces; fixedly disposing the magnet pieces thus obtained around a shaft, to obtain a roller in which a magnet layer is formed around the shaft; and magnetizing the roller to give a desired magnetic force pattern to the roller; characterized by molding at least two kinds of a first magnet piece in which anisotropic magnetic powders are oriented in such a manner as to be converged from both the side surfaces and the back surface side to a specific position on the front surface side, and a second magnetic piece in which anisotropic magnetic powders are oriented at random or uniformly or radially oriented in a specific direction from the back surface side to the front surface side, or a second magnet piece using isotropic magnetic powders with no orientation characteristic; and forming a magnetic layer by combination of the first magnetic pieces and the second magnetic pieces thus molded.

According to the magnet roller of the present invention, when a partially lower magnetic peak is required, such a requirement can be satisfied without changing dimensions of the magnet piece, and even when the position of a magnetic force peak of a magnet piece is moved, the position of the magnetic force peak can be easily moved without the need of preparation of various kinds of molds. As a result, it is possible to easily meet a requirement to attain a complex magnetic force pattern without significantly increasing the cost. Further, according to the method of manufacturing a magnet roller of the present invention, the height and position of a magnetic force peak can be easily adjusted by demagnetization and magnetization after formation of a roller. As a result, it is possible to easily manufacture a plurality of magnet rollers having complex magnetic force patterns by combination of several kinds of magnet pieces without significantly increasing the cost.

DETAILED DESCRIPTION OF THE PREFERRED EMBODIMENTS

Figure 1:
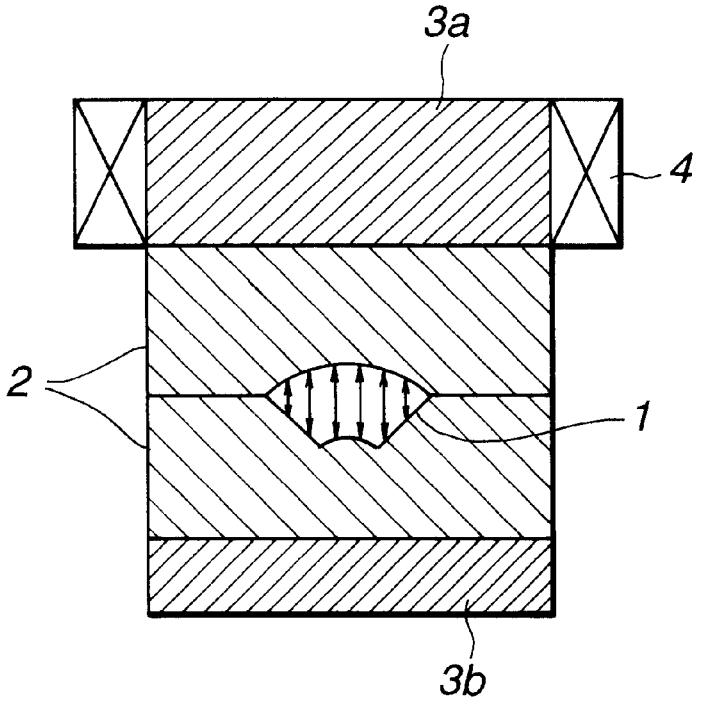
FIG. 1 is a schematic sectional view showing one example of a mold for molding a second magnet piece constituting a magnet roller of the present invention.

Hereinafter, the present invention will be described in detail.

A magnet roller of the present invention is configured, as described above, that at least two kinds of first magnet pieces and second magnet pieces different from each other in orientation characteristic of magnetic powders are fixedly disposed around the outer periphery of a shaft into a roller shape. In this case, according to the present invention, as each of the first magnet pieces, a magnet piece in which anisotropic magnetic powders are oriented in such a manner as to be converged from both the side surfaces and the back surface side to a specific position on the front surface side is used. Further, as the second magnet pieces, one kind or two or more kinds of magnet pieces selected from a magnet piece in which anisotropic magnetic powders are oriented at random, a magnet piece in which anisotropic magnetic powders are uniformly or radially oriented in a specific direction from the back surface side to the front surface side, and a magnet piece using isotropic magnetic powders with no orientation characteristic are used.

Each of the first magnet piece and the second magnet piece is a molded product in which magnetic powders are dispersed in a resin or rubber binder.

As the above binder, there can be used a thermoplastic resin such as a polyamide resin (nylon 6 or nylon 12), polystyrene resin, poly(ethylene terephthalate) resin (PET), poly(butylene terephthalate) resin (PBT), poly(phenylene sulfide) resin (PPS), ethylene-vinyl acetate copolymer resin (EVA), ethylene-ethyl acrylate resin (EEA), epoxy resin, ethylene-vinyl alcohol copolymer resin (EVOH), polypropylene resin, polyolefin (polyethylene or polyethylene copolymer), or modified polyolefin in which a reactive functional group such as maleic anhydride group, carboxyl group, hydroxyl group, or glycidyl group is introduced in a structure of the above polyolefin. Also, a mixture of one kind or two or more kinds of the above thermoplastic resins may be used as the binder. While not exclusively, of the above thermoplastic resins, polyamide resin, EVA or EEA may be preferably used. Further, as the binder, there can be used a rubber such as nitrile rubber (NBR), chloroprene rubber (CR), chlorosulfonated polyethylene (CSM) or silicone rubber.

Various kinds of magnetic powders usually used for magnet rollers may be used. In this case, according to the present invention, anisotropic magnetic powders are used for the above first magnet piece, and anisotropic or isotropic magnetic powders are used for the above second magnet piece. As the anisotropic magnetic powders, there may be used, while not exclusively, powders of a ferrite such as anisotropic Sr ferrite or anisotropic Ba ferrite; or powders of a rare earth based alloy such as anisotropic Nd—F—B alloy. The isotropic magnetic powders, may be, while not exclusively, powders of a ferrite such as isotropic Sr ferrite or isotropic Ba ferrite; or powders of a rare earth based alloy such as isotropic Nd—F—B alloy, isotropic Sm—Co alloy, or Ce—Co alloy.

The amount of the magnetic powders added, which is not particularly limited and suitably selected depending on a necessary intensity of a magnetic force, is preferably set at about 80 to 94 wt % based on the total weight of a magnet piece (density: about 2.5 to 4.5 g/cm$^2$).

Each of the first and second magnet pieces, which contains the above binder component and magnetic powders, may be further added with, as needed, a filler material having a large reinforcing effect such as mica, whisker, talc, carbon fiber, or glass fiber. That is, in the case of a molded product of a magnet piece in which a necessary magnetic force is relatively low and thereby the added amount of magnetic powders is small, the rigidity of the molded product tends to be low. Such a molded product of a magnet piece can be reinforced by addition of a filler material such as mica or whisker for increasing the rigidity. In this case, according to the present invention, mica or whisker is preferably used as the filler material. For the whisker, there may be used whisker of a non-oxide such as silicon carbide or silicon nitride; whisker of a metal oxide such as ZnO, MgO, $TiO_2$, $SnO_2$, or $Al_2O_3$; or whisker of a complex oxide such as potassium titanate, aluminum borate, or basic magnesium sulfate. In particular, for a magnet piece using a thermoplastic resin as a binder, whisker of a complex oxide easy in formation of a composite with the plastic is preferably used as a filler material.

The amount of the above filler material selectively added to a magnet piece may be, while not exclusively, in a range of about 2 to 32 wt %, preferably, in a range of about 5 to 20 wt % based on the total weight of a resin magnet. It should be noted that a resin or rubber magnet constituting each of the first and second magnet pieces may be added with an additive other than the above filler material without departing from the scope of the present invention.

Each of the first and second magnet pieces is obtained by molding a resin or rubber magnet composition containing, as described above, a binder and magnetic powders, and further a filler material and an additive as needed. In this case, each magnet piece may be, while not exclusively, formed by mixing the above components in accordance with a usual process; fusion-kneading the mixture; molding it into pellets; and injection-molding or extruding the pellet-shaped molding material. In addition, the above fusion-kneading may be performed using a biaxial kneading-extruder or KCK kneading-extruder by a usual manner under a usual condition.

Here, the above first magnet piece is configured that the above anisotropic magnetic powders are oriented in such a manner to converge from both the side surfaces of the magnet piece and the back surface side (the surface on the center side of the roller, that is, on the shaft side) to a specific position on the front surface side (the surface constituting a roller surface). Such an orientation of the magnetic powders can be obtained by injection-molding or extruding the molding material of the first magnet piece using the mold shown in FIG. 2. In addition, although the first magnet piece can be easily obtained using the mold shown in FIG. 2, it may be obtained by any process different from that using the mold shown in FIG. 2 insofar as magnetic powders can be adjusted to be oriented in such a manner as to be converged from both the side surfaces and the back surface side to a specific position on the front surface side.

Figure 4:
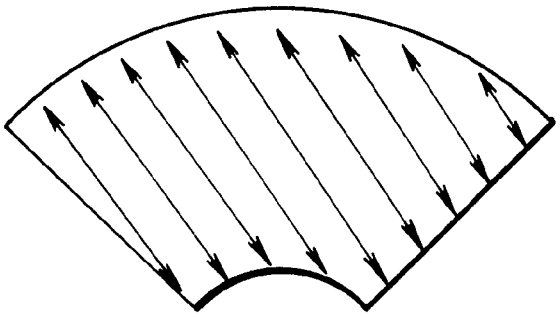
FIG. 4 is a schematic sectional view showing one example of the second magnet piece constituting the magnet roller of the present invention.

The above second magnet piece is configured such that anisotropic magnetic powders are oriented at random; anisotropic magnetic powders are uniformly or radially oriented in a specific direction from the back surface side (the surface on the center side of the roller, that is, on the shaft side) to the front surface side (the surface constituting a roller surface); or isotropic magnetic powders with no orientation characteristic are used. In this case, the second magnet piece in which magnetic powders are uniformly oriented in a specific direction from the back surface side to the front surface side may be formed by injection-molding or extruding the molding material of the second magnet piece using the mold shown in FIG. 1. Also, each of the second magnet piece in which magnetic powders are oriented at random and the second magnet piece in which isotropic magnetic powders with no orientation characteristic are used, may be formed by injection-molding or extruding the molding material of the second magnet piece without applying a magnetic field to a cavity of the mold. Here, the mode in which magnetic powders are uniformly oriented in a specific direction from the back surface side to the front surface side includes not only a mode shown in the second magnet piece 7 in FIG. 6 but also a mode, as shown in FIG. 4, in which magnetic powders are obliquely oriented (shown by arrows in FIG. 4). The mode in which magnetic powders are radially oriented from the back surface side to the front surface side can be exemplified by an orientation state shown by arrows in FIG. 5. In addition, the molding process for the second magnet piece is not limited to that described above. That is, the second magnet piece may be obtained by any process different from that described above insofar as the second magnet piece is molded such that anisotropic magnetic powders are oriented at random; anisotropic magnetic powders are uniformly or radially oriented in a specific direction from the back surface side to the front surface side; or isotropic magnetic powders are used with no orientation characteristic.

In the first magnet piece, a specific position on the front surface side to which the orientation of magnetic powders converge can be suitably set in accordance with a desired magnetic force pattern or the like. For example, the position to which the orientation of magnetic powders is converged may be offset from a central portion using the mold shown in FIG. 3; however, in general, it is preferably set at a central portion on the front surface for obtaining a high magnetic force peak.

Figure 5:
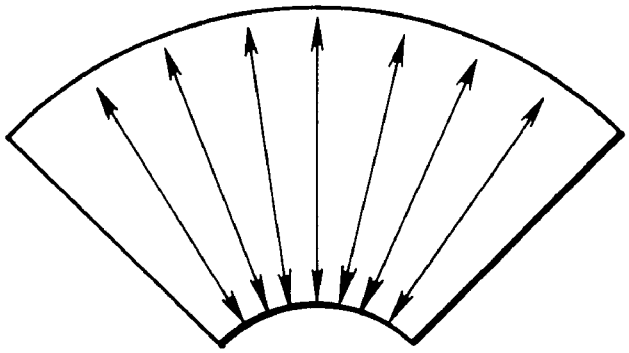
FIG. 5 is a schematic sectional view showing another example of the second magnet piece constituting the magnet roller of the present invention.
Figure 6:
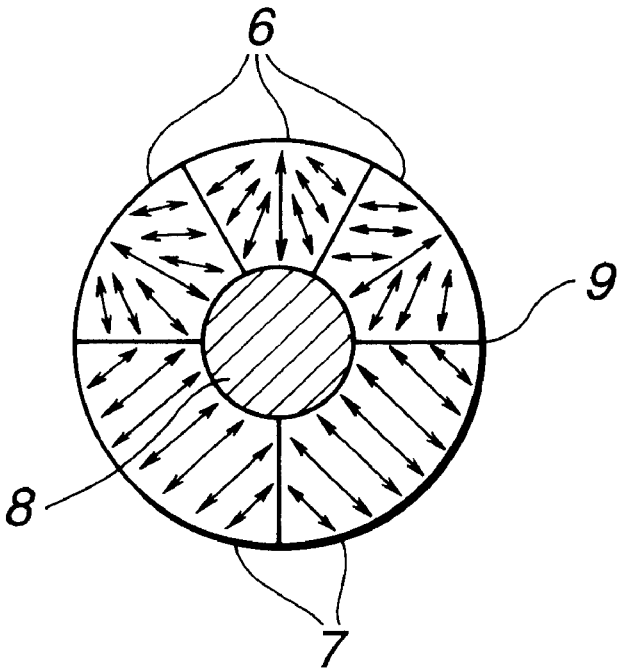
FIG. 6 is a schematic sectional view showing a magnet roller in Example 1 of the present invention, in which orientations of magnetic powders are indicated by arrows.
Figure 7:
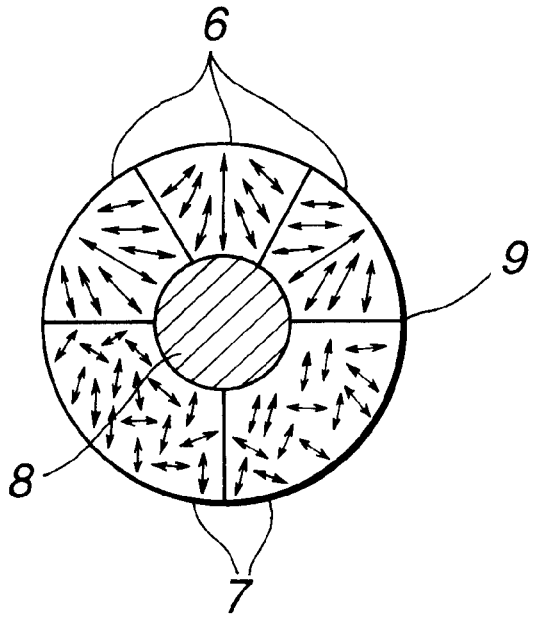
FIG. 7 is a schematic sectional view showing a magnet roller in Example 2 of the present invention, in which orientations of magnetic powders are indicated by arrows.
Figure 8:
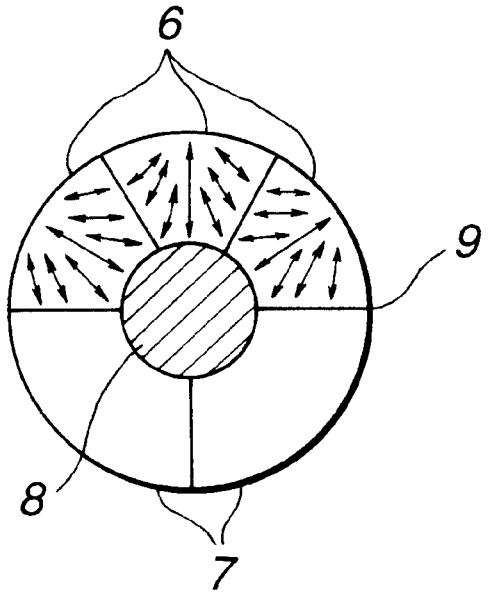
FIG. 8 is a schematic sectional view showing a magnet roller in Example 3 of the present invention, in which orientations of magnetic powders are indicated by arrows.

The magnet roller of the present invention may be configured, as shown in FIG. 6, that the first magnet pieces 6 in each of which magnetic powders are oriented (see arrows in FIG. 6) in such a manner as to be converged from both the side surfaces and the back surface side (the surface on the center side of the roller, that is, on the shaft side) to a specific position on the front surface side (the surface constituting a roller surface) and the second magnet pieces 7 in each of which magnetic powders are uniformly oriented (see arrows in FIG. 6) in a specific direction from the back surface side to the front surface side, are fixedly disposed around the outer periphery of a shaft 8 to form a magnet layer 9 around the outer periphery of the shaft 8. Also, the magnet roller may be configured, as shown in FIG. 7, such that magnet pieces in each of which magnetic powders are oriented at random are used as the second magnet pieces 7. The magnet roller may be further configured, as shown in FIG. 8, such that magnet pieces using magnetic powders having no orientation characteristic are used as the second magnet pieces 7. While not shown, the magnet roller may be configured that magnet pieces shown in FIG. 4 or 5 are used the second magnet pieces 7 shown in any one of FIGS. 6 to 8. Additionally, the magnet roller may be configured that a suitable combination of magnet pieces in each of which anisotropic magnetic powders are uniformly or radially oriented in a specific direction from the back surface side to the front surface side, magnet pieces in each of which anisotropic magnetic powders are oriented at random, and magnet pieces using isotropic magnetic powders having no orientation characteristic are used as the second magnet pieces 7 shown in any one of FIGS. 6 to 8.

Although the example in which the magnet layer 9 is composed of five pieces of the magnet pieces 6 and 7 is shown in each of FIGS. 6 and 8, the total number of the magnet pieces 6 and 7 constituting the magnet layer 9 is not particularly limited, and is suitably selected in accordance with a necessary magnetic force pattern or the like. In general, the total number of the magnet pieces 6 and 7 may be in a range of 2 to 10 pieces, preferably, in a range of 3 to 8 pieces in accordance with the number of magnetic poles and the size of a magnet roller. Further, the number of each of the first magnet pieces 6 and the second magnet pieces 7 is not particularly limited and is suitably selected in accordance with the number of magnetic poles and the intensity of a magnetic force required for each of the magnetic pieces 6 and 7. In general, the number of the first magnet pieces 6 may be in a range of 1 to 4 pieces, and the number of the second magnet pieces 7 may be in a range of 1 to 4 pieces. In the magnet roller shown in each of FIGS. 6 to 8, three pieces of the first magnet pieces constitute a semicircle portion of the magnet layer 9 and two pieces of the second magnet pieces 7 constitute the remaining semicircle portion; however, the arrangement of the magnet pieces 6 and 7 is not limited thereto. For example, the first magnet pieces 6 and the second magnet pieces 7 may be alternately arranged, and further may be suitably arranged in combination in accordance with a necessary magnetic force pattern. Also, each of the first magnet piece 6 and the second magnet piece 7 is, as shown in FIGS. 6 to 8, usually formed in a fan-shape in cross-section. However, the shape thereof is not limited to the fan-shape. That is, each of the first and second magnet pieces 6 and 7 may be formed into a suitable shape other than a fan-shape insofar as the first and second magnet pieces 6 and 7 are assembled and fixedly disposed around the outer periphery of the shaft 8 to form the magnet layer 9 around the outer periphery of the shaft 8. In addition, the shaft 8 may be a usual shaft construction such as a metal made solid or hollow shaft or a resin shaft. In this case, a shaft formed into a polygonal shape in cross-section may be used. The magnet roller of the present invention can be thus obtained by fixedly disposing the first magnet pieces 6 and the second magnet pieces 7 around the outer periphery of the shaft using a known adhesive.

Figure 10:
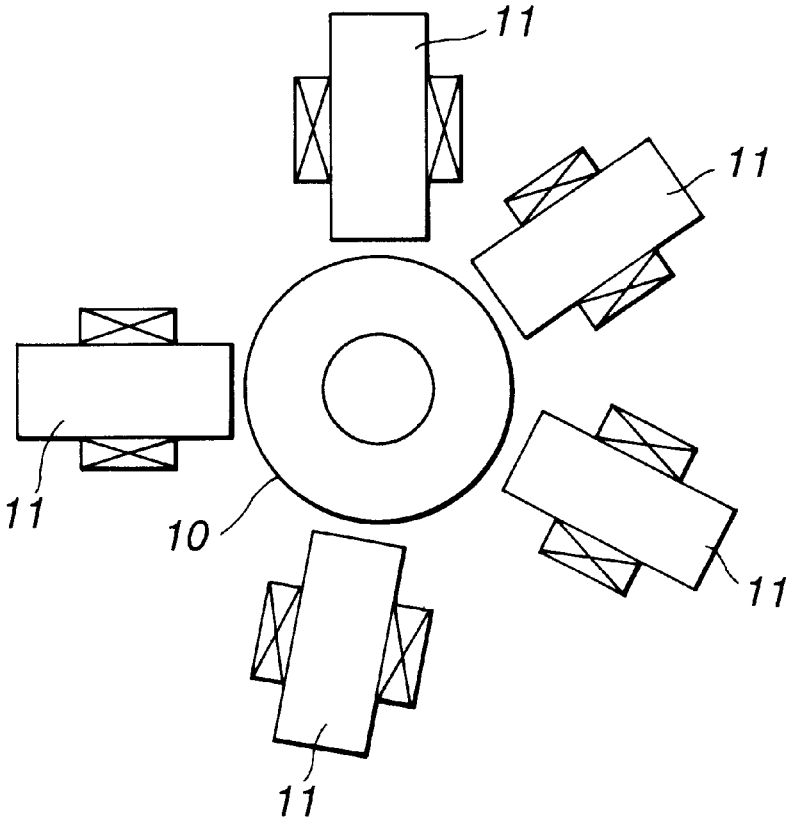
FIG. 10 is a schematic view showing one example of a magnetizing apparatus used for a manufacturing method of the present invention.

Here, in the magnet roller of the present invention, while not exclusively, the first magnet piece 6 is preferably used for a portion requiring a relatively high magnetic force peak, and the second magnet piece 7 is preferably used for a portion requiring a relatively low magnetic force peak or a portion in which the position of a magnetic force peak is required to be moved. With this arrangement, by demagnetizing once and magnetizing again the magnetic pieces 6 and 7 after molding thereof or forming the magnet roller, the height of a magnetic force peak of a portion formed of each second magnet piece 7 is adjusted at a desired height and also the position of the magnetic force peak can be moved to a desired position, as a result of which a magnetic force pattern of the magnet roller can be adjusted at a desired pattern. In this case, the demagnetizing operation and magnetizing operation can be performed in accordance with a desired magnetic force pattern by a known process using a known apparatus. The demagnetizing apparatus and the magnetizing process are exemplified, as shown in FIG. 10, by a magnetizing yoke (penta-pole magnetization is shown in the figure) in which capacitor type magnetizers 11 are arranged around the target roller 10.

The magnet roller of the present invention is suitably used as a magnet roller constituting a developing roller or cleaning roller in an electrophotographic device or electrostatic recording device such as a copying machine or a printer. In the above device, after toner remaining on a latent image support such as a photosensitive drum is scraped by a cleaning blade, the toner is recovered by the above cleaning roller. In this case, the magnet roller is disposed at a location suitable for recover of toner, wherein toner is attracted on the magnet roller by a magnetic force thereof and is peeled from the magnet roller at a specific position by a blade, to be thus recovered in a specific recovering portion.

EXAMPLE

The present invention will be more clearly understood by way of the following examples. It should be noted that the present invention is not limited to the examples.

Example 1

Three first magnet pieces 6 and two second magnet pieces 7 were injection-molded under the following conditions. These magnet pieces 6 and 7 were stuck around the outer periphery of a metal made shaft 8, to form a magnet layer 9 around the shaft 8, thus obtaining a magnet roller shown in FIG. 6. In addition, arrows in FIG. 6 indicate orientations of magnetic powders in the magnet pieces 6 and 7.

Shape and Size (1) first magnet piece 6 shape: magnet piece formed into fan-shape having central angle of 60° in cross-section diameter of outer circular-arc of fan-shape: 16 mm diameter of inner circular-arc of fan-shape: 6 mm length: 310 mm (2) second magnet piece 7 shape: magnet piece formed into fan-shape having central angle of 90° in cross-section diameter of outer circular-arc of fan-shape: 16 mm diameter of inner circular-arc of fan-shape: 6 mm length: 310 mm Molding Material (Bond Magnet Composition) (common to both magnet pieces)

binder: ethylene-ethylacrylate (EEA) 10 wt % magnetic powder: anisotropic Sr ferrite 90 wt %

Figure 2:
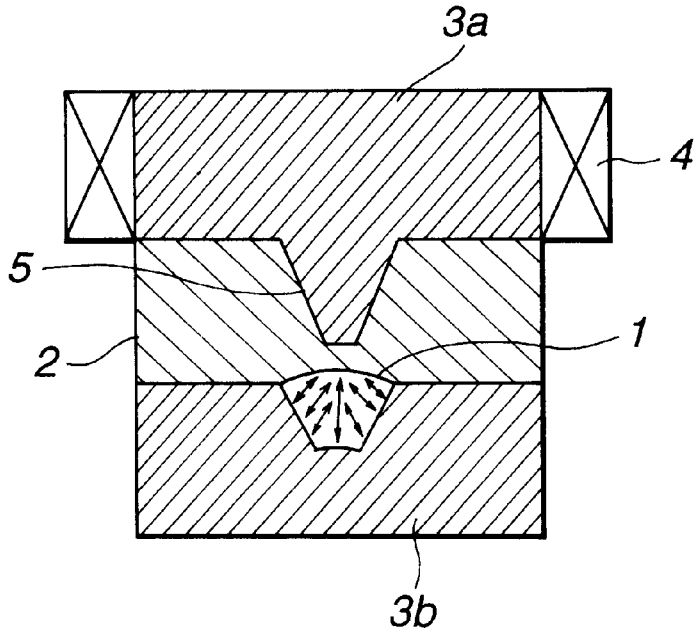
FIG. 2 is a schematic sectional view showing one example of a mold for molding a first magnet piece constituting a magnet roller of the present invention.

Mold Used (1) first magnet piece 6: mold shown in FIG. 2

(2) second magnet piece 7: mold shown in FIG. 1

Injection-molding Condition (common to both magnet pieces)

cylinder temperature: 245° C.

mold temperature: 65° C.

injection pressure: 700 (kg/cm$^2$)

Orientation State of Magnetic Powder (1) first magnet piece 6 oriented to converge from both side surfaces and back surface side to central portion on front surface side (see arrows in FIG. 6)

(2) second magnet piece 7 uniformly oriented in specific direction from front surface side to back surface side (see arrows in FIG. 6)

Figure 11:
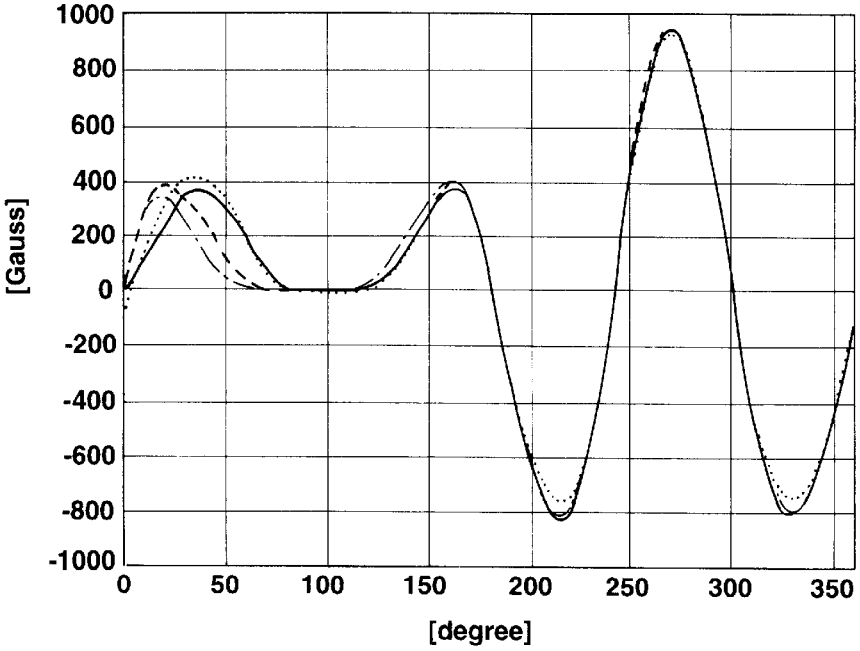
FIG. 11 is a graph showing a magnetic force pattern of the magnet roller obtained in Example 1.

The magnet rollers thus obtained were demagnetized once and then magnetized under various conditions using a magnetizing apparatus shown in FIG. 10, to obtain four kinds of magnet rollers. A surface magnetic force of each roller was measured along the peripheral direction, to obtain a magnetizing pattern of each roller. The results are shown in FIG. 11. As shown in FIG. 11, it becomes apparent that according to each magnet roller obtained in this example, the height and the position of a magnetic force peak can be easily changed and adjusted by forming the magnet roller, and demagnetizing once and magnetizing again the magnet roller, so that a plurality of magnet rollers having complex magnetic force patterns can be easily obtained.

Example 2

A magnet roller shown in FIG. 7 was obtained in the same manner as in Example 1, except that each second magnet piece 7 was molded under a condition that any magnetic field was not applied to a cavity of the mold so that magnetic powders in the second magnet piece 7 were oriented at random. The magnet rollers thus obtained were once demagnetized and then magnetized using the magnetizing apparatus shown in FIG. 10 under the same condition as that in Example 1, to obtain four kinds of magnet rollers. A surface magnetic force of each roller was measured along the peripheral direction. As a result, it was confirmed that the magnet rollers having four kinds of magnetic force patterns like Example 1 were obtained, although the magnetic force of each second magnet piece 7 portion was slightly reduced. In addition, the reduction in magnetic force was very small, and was demonstrated to be at the level with no practical problem.

Example 3

Three first magnet pieces 6 and two second magnet pieces 7 were injection-molded under the following conditions. These magnet pieces 6 and 7 were stuck around the outer periphery of a metal made shaft 8, to form a magnet layer 9 around the shaft 8, thus obtaining a magnet roller shown in FIG. 8. In addition, arrows in FIG. 8 indicate orientations of magnetic powders in the magnet pieces 6.

Shape and Size (1) first magnet piece 6 shape: magnet piece formed into fan-shape having central angle of 60° in cross-section diameter of outer circular-arc of fan-shape: 16 mm diameter of inner circular-arc of fan-shape: 6 mm length: 310 mm (2) second magnet piece 7 shape: magnet piece formed into fan-shape having central angle of 90° in cross-section diameter of outer circular-arc of fan-shape: 16 mm diameter of inner circular-arc of fan-shape: 6 mm length: 310 mm Molding Material (Bond Magnet Composition)

(1) first magnet piece 6 binder: ethylene-ethylacrylate (EEA) 10 wt % magnetic powder: anisotropic Sr ferrite 90 wt %

(2) second magnet piece 7 binder: ethylene-ethylacrylate (EEA) 10 wt % magnetic powder: isotropic Ba ferrite 90 wt %

Mold Used (1) first magnet piece 6: mold shown in FIG. 2

(2) second magnet piece 7: usual mold having no magnetic field generator

Injection-molding Condition (common to both magnet pieces)

cylinder temperature: 245° C.

mold temperature: 65° C.

injection pressure: 700 (kg/cm$^2$)

Orientation State of Magnetic Powder (1) first magnet piece 6 oriented to converge from both side surfaces and back surface side to central portion on front surface side (see arrows in FIG. 8)

(2) second magnet piece 7 no orientation characteristic

Figure 12:
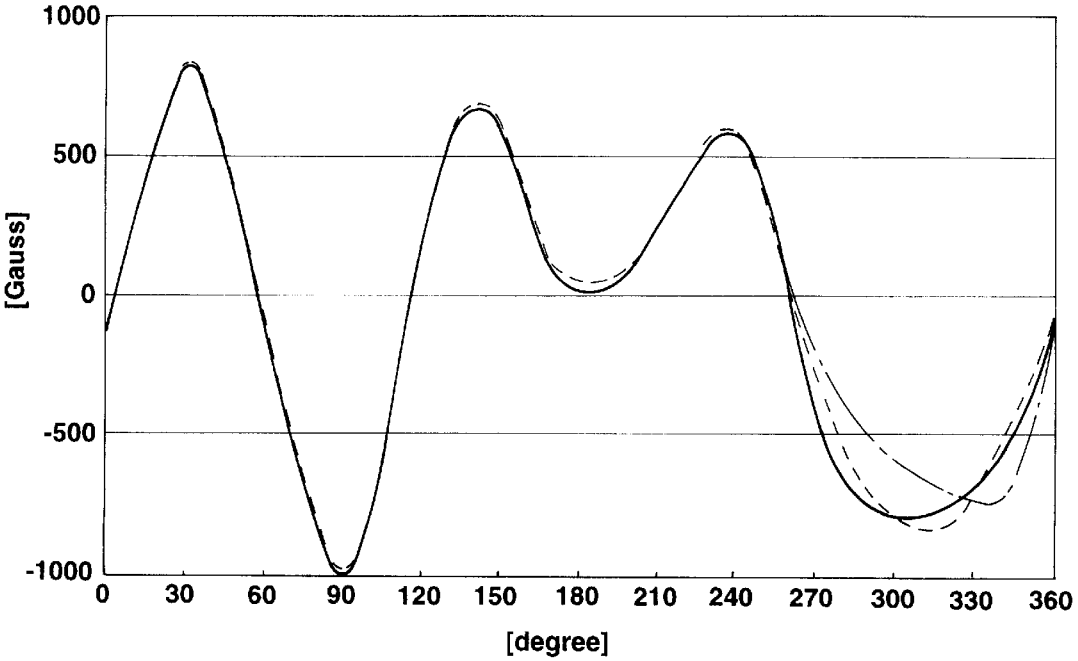
FIG. 12 is a graph showing a magnetic force pattern of the magnet roller obtained in Example 3.

The magnet rollers thus obtained were demagnetized once and then magnetized under various conditions using a magnetizing apparatus shown in FIG. 10, to obtain three kinds of magnet rollers. A surface magnetic force of each roller was measured along the peripheral direction, to obtain a magnetizing pattern of each roller. The results are shown in FIG. 12. As shown in FIG. 12, it becomes apparent that according to each magnet roller obtained in this example, the height and the position of a magnetic force peak can be easily changed and adjusted by forming the magnet roller, and demagnetizing once and magnetizing again the magnet roller, so that a plurality of magnet rollers having complex magnetic force patterns can be easily obtained.

Comparative Example

Three first magnet pieces 12 and two second magnet pieces 13 were injection-molded under the following conditions. These magnet pieces 12 and 13 were stuck around the outer periphery of a metal made shaft 8, to form a magnet layer 14 around the shaft 8, thus obtaining a magnet roller shown in FIG. 9. In addition, arrows in FIG. 9 indicate orientations of magnetic powders in the magnet pieces 12 and 13.

Shape and Size (1) first magnet piece 12 shape: magnet piece formed into fan-shape having central angle of 60° in cross-section diameter of outer circular-arc of fan-shape: 16 mm diameter of inner circular-arc of fan-shape: 6 mm length: 310 mm (2) second magnet piece 13 shape: magnet piece formed into fan-shape having central angle of 90° in cross-section diameter of outer circular-arc of fan-shape: 16 mm diameter of inner circular-arc of fan-shape: 6 mm length: 310 mm Molding Material (Bond Magnet Composition) (common to both magnet pieces)

binder: ethylene-ethylacrylate (EEA) 10 wt % magnetic powder: anisotropic Sr ferrite 90 wt %

Mold Used (1) first magnet piece 12: mold shown in FIG. 2

Figure 3:
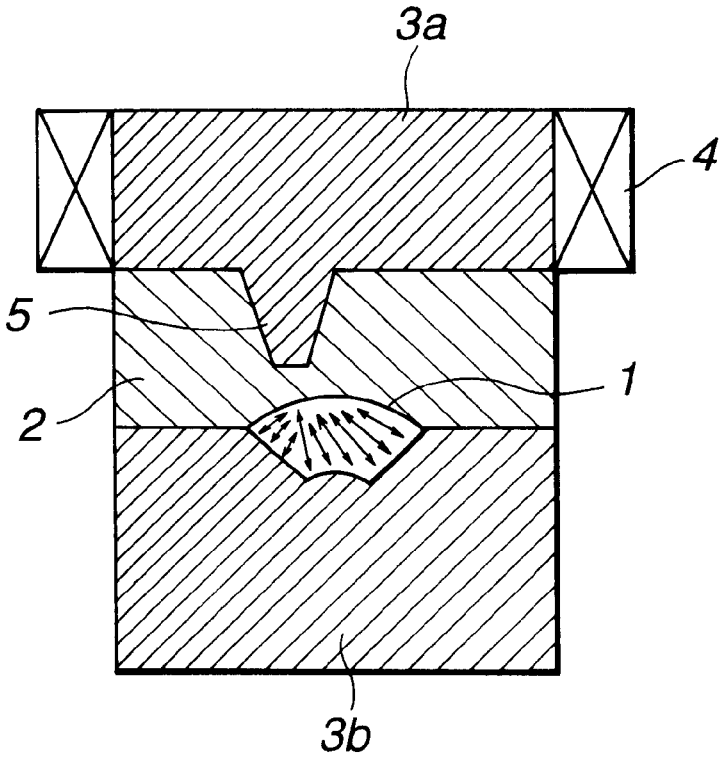
FIG. 3 is a schematic sectional view showing a mold used in Comparative Example.

(2) second magnet piece 13: mold shown in FIG. 3

Injection-molding Condition (common to both magnet pieces)

cylinder temperature: 245° C.

mold temperature: 65° C.

injection pressure: 700 (kg/cm$^2$)

Figure 9:
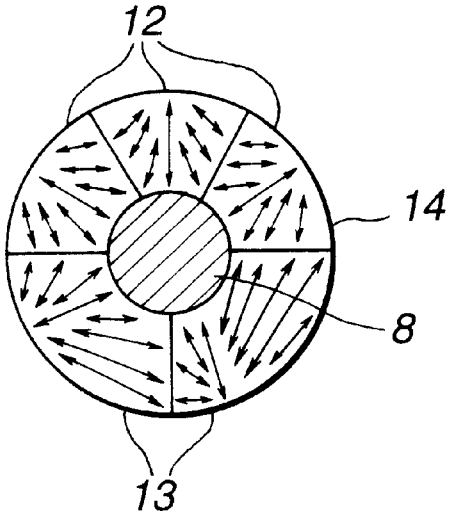
FIG. 9 is a schematic sectional view showing a magnet roller in Comparative Example of the present invention, in which orientations of magnetic powders are indicated by arrows.

Orientation State of Magnetic Powder (1) first magnet piece 12 oriented to converge from both side surfaces and back surface side to central portion on front surface side (see arrows in FIG. 9)

(2) second magnet piece 13 oriented to be converge from both side surfaces and back surface side to peripheral one end portion on front surface side (see arrows in FIG. 9)

Figure 13:
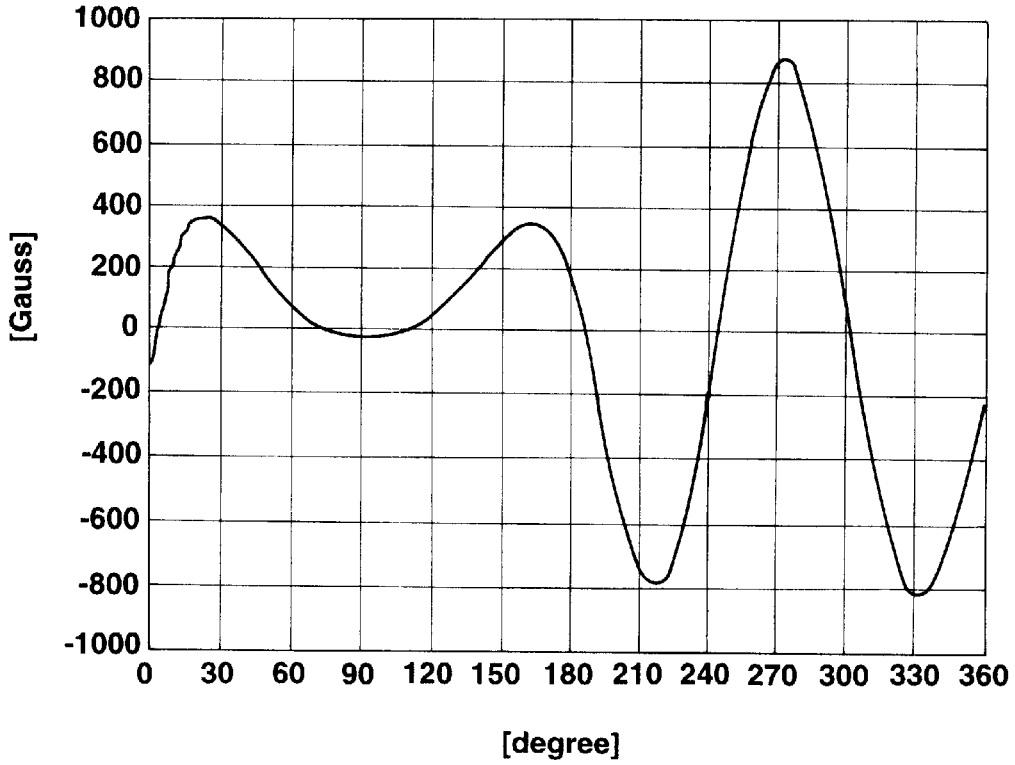
FIG. 13 is a graph showing a magnetic force pattern of the magnet roller obtained in Comparative Example.

The magnet rollers thus obtained were, like Example 1, demagnetized once and then magnetized again, to adjust magnetizing patterns, thus obtaining magnetic force patterns shown in FIG. 13. In this comparative example, however, a magnet roller practically usable was not obtained because of occurrence of a large reduction in magnetic force by movement of a magnetic force peak. As a result, according to this comparative example, it is difficult to obtain a complex magnetic force pattern by adjusting the height and the position of the magnetic force peak after formation of the magnet roller. In other words, according to this comparative example, to obtain a plurality of kinds of magnet rollers having different magnetic force patterns, even if there are only slight differences among the plurality of magnetic force patterns to be obtained, a plurality of molds corresponding to the plurality of the magnetic force patterns are required.

We claim:

1. In a magnet roller having a plurality of magnet pieces in each of which magnetic powders are dispersed in a resin or rubber binder and the magnet pieces are fixedly disposed around the outer periphery of a shaft, to form a magnet layer around the outer periphery of the shaft, the improvement wherein said plurality of magnet pieces comprise at least first magnet pieces and second magnet pieces different from each other in orientation characteristic of magnetic powders;

each of said first magnet pieces is a magnet piece in which anisotropic magnetic powders are oriented in such a manner to converge from both side surfaces and a back surface to a specific position on a front surface side; and said second magnet pieces are magnet pieces selected from a group consisting of a magnet piece in which anisotropic magnetic powders are oriented at random, a magnet piece in which anisotropic magnetic powders are uniformly or radially oriented in a specific direction from the back surface side to the front surface side, and a magnet piece using isotropic magnetic powders with no orientation characteristic, wherein the first magnet piece in which anisotropic magnetic powders are oriented in such a manner as to converge from both side surfaces and a back surface side to a specific position on a front surface side is molded using a mold in which magnetic material members are disposed on upper and lower sides of a non-magnetic material member; both side surfaces and the back surface side of the cavity are formed of the lower magnetic material member; and a projecting portion is provided on the upper magnetic material member in such a manner that the leading end of the projecting portion is located in the vicinity of a desired position of the cavity on the front surface side.

2. The magnet roller of claim 1, wherein said second magnet piece comprise a plurality of different types of magnet pieces selected from said group.

3. The magnet roller of claim 1, wherein said first and second magnet pieces is in the range of 2 to 10 pieces.

4. In a magnet roller having a plurality of magnet pieces in each of which magnetic powders are dispersed in a resin or rubber binder and the magnetic pieces are fixedly disposed around the outer periphery of a shaft, to form a magnet layer around the outer periphery of the shaft, the improvement wherein said plurality of magnet pieces comprise at least first magnet pieces and second magnet pieces different from each other in orientation characteristic of magnetic powders;

each of said first magnet pieces is a magnet piece in which anisotropic magnetic powders are oriented in such a manner as to be converged from both side surfaces and a back surface to a specific position on the front surface side; and said second magnet pieces are those in which anisotropic magnetic powders are uniformly oriented in a specific direction from the back surface side to the front surface side, wherein the first magnet piece in which anisotropic magnetic powders are oriented in such a manner as to be converged from both the side surfaces and the back surface side to a specific position on the front surface side is molded using a mold in which magnetic material members are disposed on upper and lower sides of a non-magnetic material member; both side surfaces and the back surface side of the cavity are formed of the lower magnetic material member; and a projecting portion is provided on the upper magnetic material member in such a manner that the leading end of the projecting portion is located in the vicinity of a desired position of the cavity on the front surface side, and the second magnet piece in which anisotropic magnetic powders are uniformly oriented in a specific direction from the back surface side to the front surface side is molded using a mold in which magnetic material members are disposed on upper and lower sides of a non-magnetic material member; one of the upper and lower magnetic material members has no projecting portion; and a cavity is formed in the non-magnetic material member portion.

5. A magnet roller according to claim 4, wherein a relatively high magnetic force peak is formed in a portion of said first magnet piece and a relatively low magnetic force peak is formed in a portion of said second magnet piece.

6. In a method of manufacturing a magnet roller, comprising the steps of:

molding a resin or rubber magnet composition in which magnetic powders are disposed in a resin or rubber binder using a mold, to form a plurality of magnet pieces;

fixedly disposing the magnet pieces thus obtained around a shaft, to obtain a roller in which a magnet layer is formed around the shaft; and magnetizing the roller to give a desired magnetic force pattern to the roller;

the improvement comprising the steps of:

molding at least a first magnet piece in which anisotropic magnetic powders are oriented in such a manner to converge from both side surfaces and a back surface side to a specific position on the front surface side, and a second magnetic piece in which anisotropic magnetic powders are oriented at random, uniformly or radially in a specific direction from the back surface side to the front surface side, or a second magnet piece using isotropic magnetic powders with no orientation characteristic; and forming a magnetic layer by combination of the first magnetic pieces and the second magnetic pieces thus molded, wherein the first magnet piece in which anisotropic magnetic powders are oriented in such a manner to converge from both the side surfaces and the back surface side to a specific position on the front surface side is molded using a mold in which magnetic material members are disposed on upper and lower sides of a non-magnetic material member; both side surfaces and the back surface side of the cavity are formed of the lower magnetic material member; and a projecting portion is provided on the upper magnetic material member in such a manner that the leading end of the projecting portion is located in the vicinity of a desired position of the cavity on the front surface side.

7. A method of making a magnetic roller according to claim 6, further comprising the step of forming a relatively high magnetic force peak in a portion of said first magnet piece and forming a relatively low magnetic force peak in a portion of said second magnet piece.

8. In a method of manufacturing a magnet roller, comprising the steps of:

molding a resin or rubber magnet composition in which magnetic powders are disposed in a resin or rubber binder using a mold, to form a plurality of magnet pieces;

fixedly disposing the magnet pieces thus obtained around a shaft, to obtain a roller in which a magnet layer is formed around the shaft; and magnetizing the roller to give a desired magnetic force pattern to the roller;

the improvement comprising the steps of:

molding at least a first magnet piece in which anisotropic magnetic powders are oriented in such a manner to converge from both side surfaces and a back surface side to a specific position on a front surface side, and a second magnetic piece in which anisotropic magnetic powders are uniformly oriented in a specific direction from the back surface side to the front surface; and forming a magnetic layer by combination of the first magnetic pieces and the second magnetic pieces thus molded, wherein the first magnet piece in which anisotropic magnetic powders are oriented in such a manner to converge from both the side surfaces and the back surface side to a specific position on the front surface side is molded using a mold in which magnetic material members are disposed on upper and lower sides of a non-magnetic material member; both side surfaces and the back surface side of the cavity are formed of the lower magnetic material member; and a projecting portion is provided on the upper magnetic material member in such a manner that the leading end of the projecting portion is located in the vicinity of a desired position of the cavity on the front surface side, and the second magnet piece in which anisotropic magnetic powders are uniformly oriented in a specific direction from the back surface side to the front surface side is molded using a mold in which magnetic material members are disposed on upper and lower sides of a non-magnetic material member; either of the upper and lower magnetic material members has no projecting portion; and a cavity is formed in the non-magnetic material member portion.

9. A method of making a magnet roller according to claim 8, further comprising the step of forming a relatively high magnetic force peak in a portion of said first magnet piece and forming a relatively low magnetic force peak in a portion of said second magnet piece.

* * * * *